US005472211A

United States Patent [19]

McCaughan

[11] Patent Number: 5,472,211

[45] Date of Patent: Dec. 5, 1995

[54] OUTDOOR GAME APPARATUS

[76] Inventor: Thomas E. McCaughan, 28 College Dr., Babson Park, Fla. 33827

[21] Appl. No.: 436,740

[22] Filed: May 8, 1995

[51] Int. Cl.[6] ..... A63B 67/06

[52] U.S. Cl. ..... 273/401; 273/402

[58] Field of Search ..... 273/398, 400, 273/401, 402, 126 RA

[56] References Cited

U.S. PATENT DOCUMENTS

| | | | |
|---|---|---|---|
| 469,554 | 2/1892 | Favor | 273/401 |
| 922,717 | 5/1909 | Parker | 273/401 |
| 3,653,662 | 4/1972 | Welbourn | 273/400 |
| 4,012,042 | 3/1977 | Blasingame | 273/401 |
| 4,203,592 | 5/1980 | Quatkemeyer | 273/398 X |
| 4,204,682 | 5/1980 | Brown | 273/401 |
| 4,717,156 | 1/1988 | Wright | 273/401 |
| 4,927,161 | 5/1990 | Brenneman | 273/402 |
| 4,974,858 | 12/1990 | Knowlton | 273/401 |
| 5,060,955 | 10/1991 | Bible | 273/400 |
| 5,286,034 | 2/1994 | Haverkate et al. | 273/401 |

*Primary Examiner*—William H. Grieb
*Attorney, Agent, or Firm*—William M. Hobby, III

[57] ABSTRACT

An outdoor game apparatus has a pair of concrete game surfaces formed on the ground a predetermined distance from each other with each game surface having a plurality of openings therein spaced in a predetermined relationship. Each concrete game surface has a predetermined score mark adjacent each opening therein and each opening has a drainage opening in the bottom thereof to drain water therefrom. Each of a plurality of plastic game discs has a piece of ferric metal formed therein and is sized to fit into each opening in the game surface so that a player standing adjacent one concrete game surface can throw the game disc towards the other game surface for scoring points when the disc goes in one of the openings. The game includes a pair of elongated wands, each having a permanent magnet attached to the end thereof for each player to selectively retrieve a game disc from an opening in the concrete game surface by magnetically adhering to the ferric metal formed in the disc. Thus, alternating players can toss game discs towards a concrete surface to score points and discs that enter the game surface opening, are retrieved by the other player with a magnetic wand for tossing back towards the opposite game surface.

7 Claims, 1 Drawing Sheet

OUTDOOR GAME APPARATUS

BACKGROUND OF THE INVENTION

The present invention relates to an outdoor game apparatus and especially to a game apparatus having concrete playing surfaces and a disc or plurality of discs which are tossed back and forth towards openings in the game surface for scoring points.

In the past, a wide variety of games have been devised which use pucks, disks, and balls for throwing or sliding by a player towards a target or scoring area. These games are sometimes scored by the position they land on the target. One such game is shuffleboard in which discs are slid with a mallet on a game surface from one end to the other end of the surface with the object being to have the disc stop sliding on the scoring surface. There have been a number of U.S. patents that work by throwing discs, or the like, towards a scoring surface and these may be seen in the Brown U.S. Pat. No. 4,204,682, for a method and apparatus for an outdoor tossing game in which holes are placed at predetermined distances apart, so that a player can throw a marker, which is constructed of heavy metal, towards a cup formed in the earth. In the Bible U.S. Pat. No. 5,060,955, a game apparatus and associated playing method also has cups formed in the earth and spaced a predetermined distance apart for throwing discs or coins towards the cups. The discs are directed towards an inside perimeter for scoring and a higher score results when a disc falls in the cup. The Knowlton U.S. Pat. No. 4,974,858, teaches a tossing game which may be used indoors or outdoors similar to horseshoes and includes a pair of boards which are positioned and spaced apart so that players may stand behind a particular board and throw washers into holes located in the opposing board.

In the Blasingame U.S. Pat. No. 4,012,042, an invertible pocketed target for a disc throwing game is provided in which disc shaped projectiles are thrown towards a target having pockets therein and in which the target can be inverted. In the Wright U.S. Pat. No. 4,717,156, a tossing game is provided for tossing a projectile towards a base having a cavity formed therein. The base is shaped like a truncated cone having a cavity formed therein and flared at the mouth of the cavity. In the Favor U.S. Pat. No. 469,554, a game apparatus is provided which includes a canvas material having pockets formed therein and supported on upright poles so that throwing a ball towards the different pockets can result in different scores. The Haverkate et al. U.S. Pat. No. 5,286,034, is a disc pitching game which includes discs made of rubber for throwing towards a board having cups in the center thereof which cups allow the entrance of the thrown discs. The cup is an inverted cone-shape with a round protrusion in the bottom thereof to assist in removing the disc from the cups.

The present invention relates to a disc tossing game and uses a specially curved disc having a ferric metal embedded therein which is thrown by one player standing on or beside one of the surfaces and tossing at the other surface to hit one of a plurality of openings. The player adjacent the other surface can rapidly retrieve all of the thrown discs with a magnetic wand and then toss the discs back towards the opposite game surface. Game surfaces are constructed to be maintenance free while the disc are constructed for easy retrieval.

SUMMARY OF THE INVENTION

An outdoor game apparatus has a pair of concrete game surfaces formed on the ground a predetermined distance from each other with each game surface having a plurality of openings therein spaced in a predetermined relationship. Each concrete game surface has a predetermined score mark adjacent each opening therein and each opening has a drainage opening in the bottom thereof to drain water therefrom. Each of a plurality of plastic game discs has a piece of ferric metal formed therein and is sized to fit into each opening in the game surface so that a player standing adjacent one concrete game surface can throw the game disc towards the other game surface for scoring points when the disc goes in one of the openings. The game includes a pair of elongated wands, each having a permanent magnet attached to the end thereof for each player to selectively retrieve a game disc from an opening in the concrete game surface by magnetically adhering to the ferric metal formed in the disc. Thus, alternating players can toss game discs towards a concrete surface to score points and, when a disc enters a game surface opening, it is retrieved by the other player with a magnetic wand for tossing back towards the opposite game surface.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figures 1, 2, 3, 4, 5, 6:
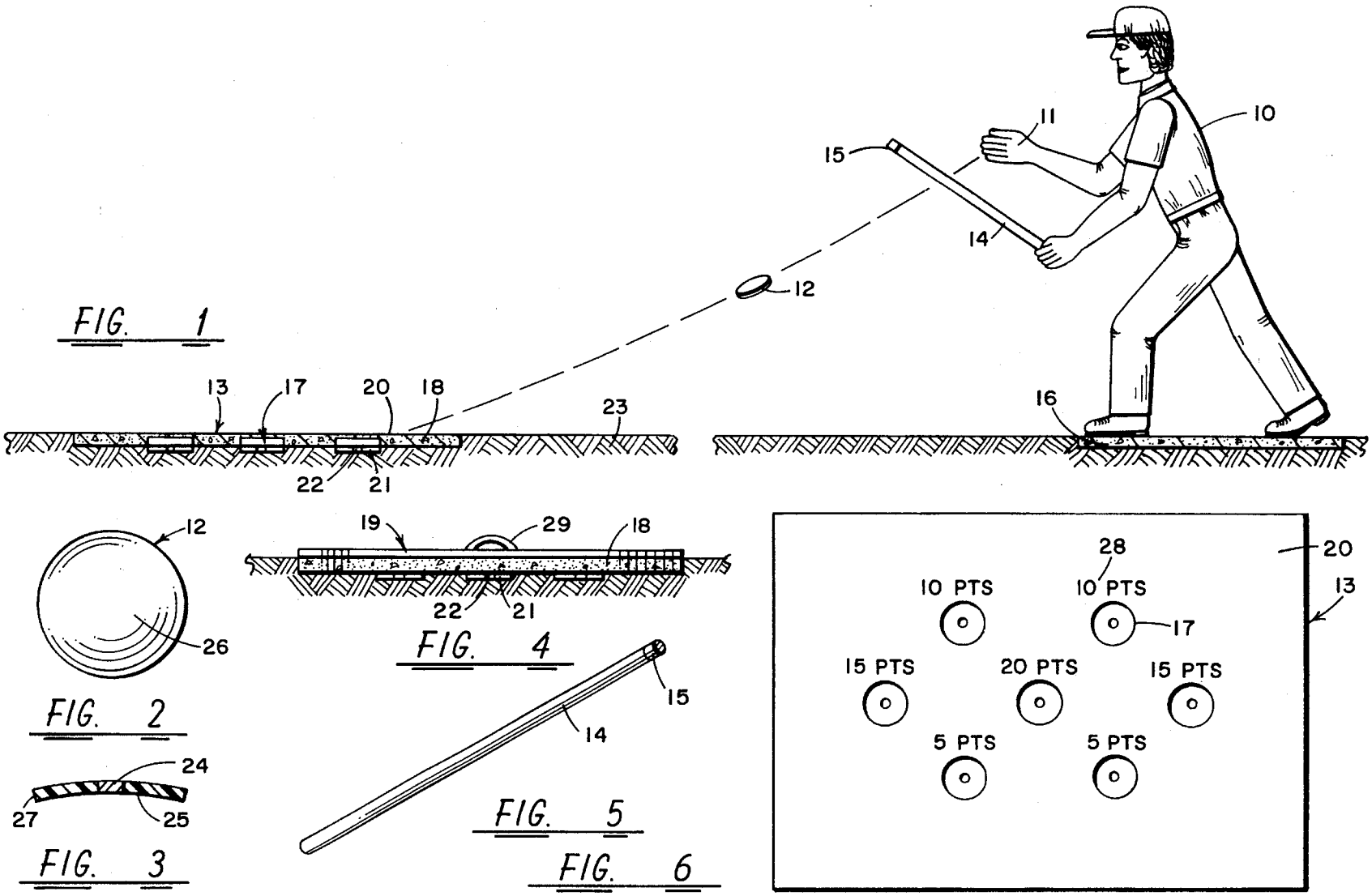
FIG. 1 is a partial sectional view of a player playing a game on the outdoor game apparatus of the present invention.
FIG. 2 is a top elevation of a game disc in accordance with the present invention.
FIG. 3 is a sectional view taken through the game disc of FIG. 2.
FIG. 4 is a sectional view taken through the game surface of FIG. 1.
FIG. 5 is a perspective view of a magnetic wand of the present invention.
FIG. 6 is a top plan view of the game surface of FIGS. 1 and 4.

Referring to the drawings, FIGS. 1–6, a game apparatus is illustrated in FIG. 1 and has a player 10 using his right hand 11 to toss a game disc 12 towards a game surface 13. The player 10 is holding a wand 14 in his left hand having permanent magnet 15 attached to the end thereof. The player is standing adjacent a game surface 16 which is identical to the game surface 13. Game surface 13 has a plurality of openings 17 therein. Each game surface 13 is formed of a poured concrete 18 having the pockets or openings 17 formed therein. There may be seven pockets, as shown in FIG. 6 in the top surface 20 for the disc 12 to slide on and into one of the seven pockets formed in the game surface 13. Each pocket 17 has a flat bottom 21 which has an opening 22 formed therein adjacent the earth 23 therebeneath so that water, which may accumulate during rain or cleaning, will drain through the openings 22 and into the surrounding earth.

As noted in FIG. 1, the game player 10 is standing beside the game surface 16 and throwing a disk towards the game surface 13. A player would also be standing adjacent the game surface 13 for retrieving all the thrown discs for tossing back towards the game surface 16. The game disc 12 may be made of a polymer or plastic material having a ferric metal member 24 embedded in the center thereof and may be formed in an arcuate shape with an arcuate surface 25 therebeneath and having an arcuate top surface 26.

Each concrete base 18, as seen in FIG. 4, may have a cover 19 to cover the surface 13 when not in use. The cover 19 has a lifting handle 29.

The wand 14 having the permanent magnet 15 mounted on the end thereof is held in each player's non-playing hand, which may be either the left or right hand, depending upon whether a person is left or right handed. The wand is used to reach down with the magnetic tip 15 to engage the ferric metal member 24 in the disc 12 to rapidly recover the disc from the openings 17 or from the surface when the disc does not fall into an opening. The player may then rapidly, without waste of time, toss the disc or discs back towards the other game surface 16 so that the discs may be thrown back and forth in rapid order. The player at each end scores his opponent when he picks the disc up with his wand 14. Each opening 17 has markings 28 adjacent thereto indicating the number of points. The markings 28 may indicate 10 points, 15 points, 5 points, or 20 points. The markings 28 can be painted on the surface 16 or may be slightly embedded into the concrete where the number of points have been selected based upon the difficulty of getting the disc 12 into the particular opening. Thus, the disc 12 is shaped for ease of throwing and sliding on a surface and for the rapid recovery of each disc for throwing towards the opposite game surface by the player adjacent the one game surface.

It should be clear at this time that an outdoor game apparatus and game has been provided which is permanently installed in concrete game surfaces and allows for a fast action toss game in which each player can rapidly recover the discs for tossing back to the opposite game surface. The game surfaces are formed so as not to require maintenance, such as having to remove rain water, from the poured concrete openings. However, the present invention should not be construed as limited to the forms shown which are to be considered illustrative rather than restrictive.

I claim:

1. An outdoor game apparatus comprising:

a pair of concrete game surfaces formed on the ground a predetermined distance from each other, each game surface having a plurality of openings therein, each opening being in a predetermined spaced relationship from the other opening therein and each said concrete game surface having a predetermined score marked adjacent each opening therein and each concrete playing surface opening having a drainage opening in the bottom thereof to drain water therefrom;

a plurality of plastic game discs, each game disc having a piece of ferric metal formed therein and each game disc being sized smaller than each game surface opening, whereby a game piece can be thrown by alternating players, each standing adjacent one concrete game surface and throwing towards the opening in the other spaced concrete game surface for scoring points when a game disc enters an opening; and a pair of elongated wands, each having a permanent magnet attached thereto for each player to selectively retrieve a game disc from an opening in one concrete game surface, whereby alternating players can toss a game disc towards a concrete game surface to score upon a disc entering a game surface opening and then retrieved by the other player with a magnetic wand for tossing towards the opposite game surface.

2. An outdoor game apparatus in accordance with claim 1 in which each said concrete game surface has seven openings therein with the highest points being the center and rear openings.

3. An outdoor game apparatus in accordance with claim 2 in which said elongated wand has a permanent magnet attached to one end thereof.

4. An outdoor game apparatus in accordance with claim 3 in which said game disc has a piece of ferric metal formed in the middle portion thereof.

5. An outdoor game apparatus in accordance with claim 4 in which said game disc has a piece of iron formed therein.

6. An outdoor game apparatus in accordance with claim 5 in which each said concrete game surface has a numeric score painted on the concrete surface adjacent each opening therein.

7. An outdoor game apparatus in accordance with claim 5 in which said concrete game surface has each numeric score formed with indentations in the concrete surface of each concrete game surface.

* * * * *